US009057236B2

(12) United States Patent
Høgset et al.

(10) Patent No.: US 9,057,236 B2
(45) Date of Patent: Jun. 16, 2015

(54) METHOD FOR INITIATING FLUID CIRCULATION USING DUAL DRILL PIPE

(71) Applicant: Reelwell, A.S., Royneberg (NO)

(72) Inventors: Tore Høgset, Stavanger (NO); Harald Syse, Royneberg (NO)

(73) Assignee: Reelwell, A.S., Stavanger (NO)

( * ) Notice: Subject to any disclaimer, the term of this patent is extended or adjusted under 35 U.S.C. 154(b) by 424 days.

(21) Appl. No.: 13/625,016

(22) Filed: Sep. 24, 2012

(65) Prior Publication Data

US 2014/0083776 A1 Mar. 27, 2014

(51) Int. Cl.
*E21B 21/12* (2006.01)
*E21B 21/10* (2006.01)

(52) U.S. Cl.
CPC ..... *E21B 21/12* (2013.01); *E21B 21/10* (2013.01)

(58) Field of Classification Search
CPC ..... E21B 21/12; E21B 21/10
See application file for complete search history.

(56) References Cited

U.S. PATENT DOCUMENTS

| | | | | |
|---|---|---|---|---|
| 3,268,017 | A * | 8/1966 | Yarbrough | 175/25 |
| 5,586,609 | A | 12/1996 | Schuh | |
| 2011/0180269 | A1 * | 7/2011 | Vestavik | 166/373 |
| 2013/0220623 | A1 * | 8/2013 | Alhaug et al. | 166/321 |

OTHER PUBLICATIONS

Notification of Transmittal of the International Search Report and the Written Opinion of the International Searching Authority, or the Declaration, International Application No. PCT/EP2013/069160, Jul. 16, 2014.

* cited by examiner

*Primary Examiner* — Nichole Coy
(74) *Attorney, Agent, or Firm* — Richard A. Fagin

(57) ABSTRACT

A method for operating a dual drill string disposed in a wellbore, the string having a shutoff valve for at least a fluid return drill string therein proximate a bottom end thereof includes pumping fluid into the fluid return string such that a pressure therein is substantially equal to a fluid pressure in the wellbore. Circulation of fluid in the wellbore is initiated by pumping fluid into a fluid supply string of the dual drill string such that the shutoff valve on the fluid return string opens to enable the fluid leaving the wellbore to enter the fluid return string.

7 Claims, 4 Drawing Sheets

METHOD FOR INITIATING FLUID CIRCULATION USING DUAL DRILL PIPE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to the field of dual drill pipe strings. More specifically, the disclosure relates to an actuator and a valve system and configurations of a valve system used with dual drill strings.

It is known in the art of subsurface wellbore drilling to use a single pipe string, two parallel pipes or two nested or concentric pipe strings. Concentric or nested pipe strings refer to a string consisting of inner pipe joints arranged within outer pipe joints connected end to end.

In concentric or nested drill strings, the inner pipe forms part of a flow bore extending from the surface to a drill bit at the lower end of the drill string. An annulus between the outer pipe and inner pipe forms part of a second flow bore extending from the surface to the drill bit. Further, it is known to provide barriers or valves (e.g., check valves) in the pipe string to prevent gas-kicks, blow-outs etc. to move to the surface during drilling operations. Drilling operations may refer to the drilling of a wellbore, including the connection and disconnection of pipe segments (joints or multiple joint "stands") during drilling operations. The barriers may be in the form of valves in the flow bores, arranged to provide seals against uncontrolled flow, such as gas-kicks and blow-outs. The valves may be check valves allowing flow in one direction and preventing flow in the other direction.

The term "drilling" as used herein should be understood to refer to creation of a hole in the subsurface by means of the pipe string. It particularly applies for drilling in the crust of the earth for petroleum recovery, tunnels, canals or for recovery of geothermal energy, both offshore and onshore.

U.S. Patent Application Publication No. 2010/0116501 A1 discloses a backup safety flow control system for concentric drill strings. The '501 publication shows a primary annulus shutoff valve assembly and a backup annulus shutoff valve assembly in the annular bore, and a primary inner bore shutoff valve assembly in the inner bore. In addition, in case the primary inner bore shutoff valve assembly fails, the flow control system includes a backup inner bore shutoff valve by means of a valve that may be dropped from the surface through the inner bore. When the wellbore pressure is brought under control, the drill string can be removed from the well so that the backup inner shutoff valve may be removed.

Other dual drill string systems may include a valve to close both the inner pipe string proximate the bottom end thereof and the outer pipe proximate the bottom end thereof when fluid pumping from the surface is stopped. When such valves are affixed proximate the bottom end of a dual drill string, and the dual drill string is inserted into ("tripped" or "run") the wellbore, the interior of both the outer drill string and the inner drill string will be void of drilling fluid. In other cases, the dual drill string may remain fluid filled, but pressures may be reduced therein when fluid circulation is stopped for any reason. Upon resumption of fluid flow ("circulation"), the one of the inner or outer drill string carrying the fluid under pressure from the surface will become charged with drilling fluid until an actuation pressure of the shutoff valve is exceeded. However, upon the pressure in the wellbore annulus exceeding the opening pressure of the other shutoff valve, that is, the valve which closes the fluid return path, the fluid will be exposed to an air-filled conduit or to a liquid filled conduit that has pressure lower than the wellbore pressure because on cessation of fluid circulation the shutoff valve will lock in a pressure in the return conduit that represents the wellbore pressure less fluid flow friction loss pressure. Thus, lower pressure will exist at the moment of opening the other shutoff valve. Such lower pressure may cause rapid drop in the pressure of fluid in the wellbore, which may lead to wellbore collapse and/or fluid influx from formations exposed to the wellbore.

There exists a need for a method of operating a dual drill string in a wellbore and initiating circulation without exposing the wellbore to relatively low pressure upon opening of a drill string shutoff valve.

SUMMARY

A method according to one aspect for operating a dual drill string in a wellbore, the drill string having a shutoff valve for at least a fluid return drill string therein proximate a bottom end thereof includes pumping fluid into the fluid return string such that a fluid pressure therein is substantially equal to a fluid pressure in the wellbore. Circulation of fluid in the wellbore is initiated by pumping fluid into a fluid supply string in the dual drill string such that the shutoff valve on the fluid return string opens to enable the fluid leaving the wellbore to enter the fluid return string.

Other aspects and advantages will be apparent from the description and claims which follow.

DETAILED DESCRIPTION

Figure 1:
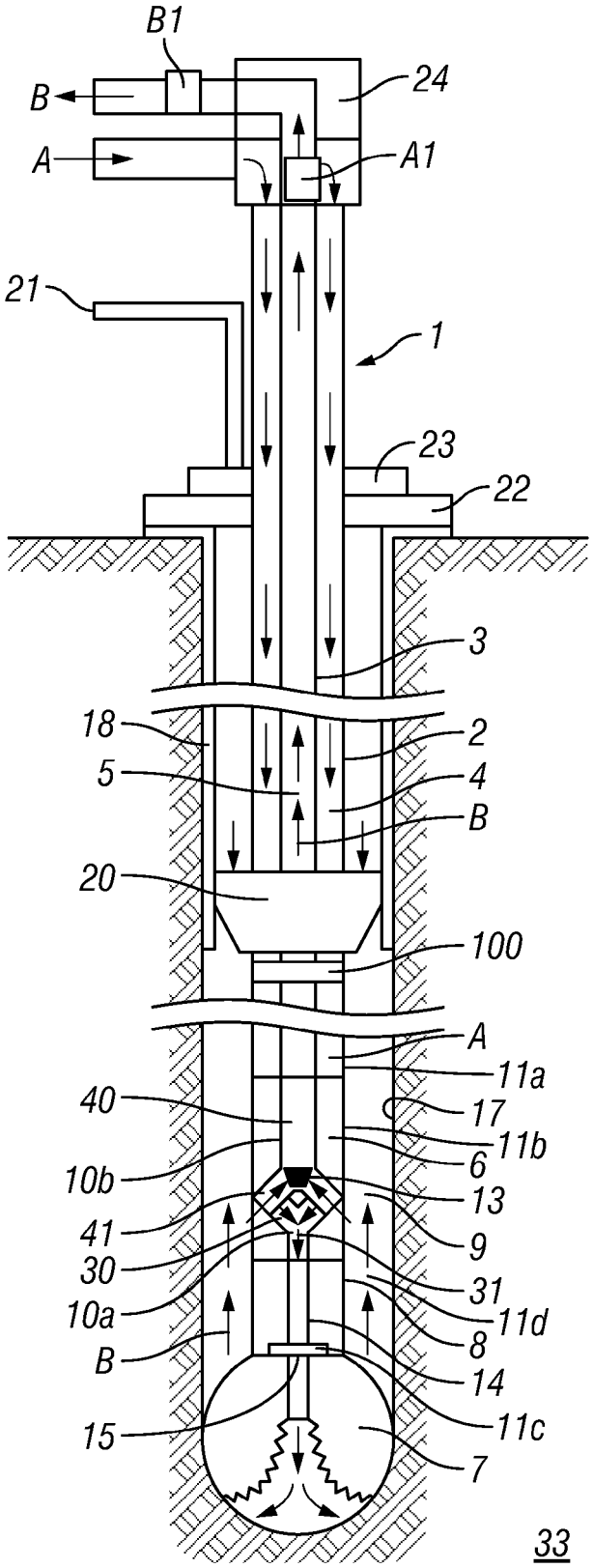
FIG. 1 shows an example drilling arrangement using a nested or concentric drill pipe string and drill string valves.

In FIG. 1 a nested or concentric dual drill string 1 is shown inserted in a wellbore 17 being drilled through subsurface formations 33. The wall of the wellbore 17 creates an annular space (well annulus 9) between the exterior of the dual drill string 1 and the wall of the wellbore 17. The dual drill string 1 may comprise a dual bore drill pipe consisting of an inner pipe 3 arranged within an outer pipe 2. A supply flow of drilling fluid (e.g., "drilling mud"), shown at A, is introduced through a suitable swivel 24 such as a top drive into an annular bore ("fluid supply flow passage") 4 disposed between the inner pipe 3 and the outer pipe 2. The supply flow of drilling fluid A may be ultimately directed to a drill bit 7 that cuts the formations 33. A return flow of drilling fluid, shown at B is transported from the bottom of the wellbore 17 in an inner bore ("return fluid passage") 5 within the inner pipe 3.

In the example shown in FIG. 1, the dual drill string 1 may be arranged with a piston 20 fixed to the dual drill string 1 and in sealing contact with the wall of the wellbore 17. The top drive 24 may also rotate or drive the dual drill string 1. A blow out preventer (BOP) 22 and a rotating control device (RCD) 23 may be arranged at the top of the wellbore 17. By the arrangement of the RCD 23 and piston 20, an isolated space is provided in the upper part of the wellbore 17. In the present example, a fluid may be introduced through a fluid inlet 21 into the isolated space. The introduced fluid provides a pressure to the piston 20, thereby forcing the piston 20 and the dual drill string 1 downwards when drilling is performed. As will be appreciated by those skilled in the art, other arrangements than the piston 20 shown in FIG. 1 may be used for providing a driving force to the dual drill string 1, or may be omitted, wherein the isolated space in the wellbore annulus 9 is closed by the BOP 22 and RCD 23. Thus, the use of the piston 20 in the wellbore annulus 9 is not a limitation on the scope of the invention.

The dual drill string 1 is typically arranged with a flow diverter 6 at a lowe4r end thereof connected to a bottom hole assembly (BHA) 8 holding the bit 7 at a lower end portion of the drill string. The bottom hole assembly (BHA) 8 may a standard type BHA that can be used with conventional (single flow bore) drill pipe and drilling tools, including, without limitation, hydraulic (mud) motors, drill collars, measurement and/or logging while drilling tools. The BHA may also be a reverse flow type such as used in air drilling mining operations. The flow diverter 6 has a flow passage assembly 10*a* providing a fluid connection between the fluid supply flow passage 4 of the dual drill string 1 and a channel 14 or channel assembly of the BHA 8. The channel 14 of the BHA 8 is shown in the example of FIG. 1 with the shape of an axial bore, and the flow passage assembly 10*a* is shown with essentially a Y-shape in an axial cross section. First diverging branches 30 of the Y fit in connection with the fluid supply flow passage 4, and an axial passage part 31 corresponds to the stem portion of the Y and fits in connection with the axial shaped channel 14 of the BHA. The supply flow A exits from the channel 14 into the BHA 8 and thence into the cutting area of the drill bit 7.

From the drill bit 7, the return fluid flow B moves in the well annulus 9 into a return flow passage assembly 10*b* arranged in the flow diverter 6. The axial cross section of a return flow passage assembly 10*b* also has a Y shape with second diverging branches 41 opening at one end into the well annulus 9 and an axial passage part 40 connected with the fluid return flow passage 5. The return flow B enters the inlet of the flow diverter return flow passage 10*b* and returns in the fluid return flow passage 5 of the dual string 1.

The dual drill string 1 may be arranged, for example, with a selected number of valve elements (four shown in the present example), although the number of such valves and their placement within the drill string is not intended to limit the scope of the invention. Two of the valve elements may be arranged for closing and opening of the fluid supply flow A, and two of the valve elements may be arranged for closing and opening of the fluid return flow B. By such arrangement of valve elements, a double barrier system may be provided both for the control of the fluid supply flow A and for control of the fluid return flow B. The closing of the valve elements may be performed, in some examples automatically if the drilling system needs to close down, and in case of emergency, for example, a kick or other unwanted well fluid control conditions. Other examples of valve elements, to be described in more detail below, may close both the fluid supply flow passage 4 and the return fluid passage 5.

In FIG. 1 example locations of the four valve elements are shown schematically. Two bottom valves 11*c*, 11*d* provided for opening and closing the supply flow A, may be located in the bottom hole assembly 8. The bottom valves 11*c*, 11*d* may be positioned to open and close the channel 14, and one of the bottom valves, e.g., 11*d*, may be positioned to control the opening and closing of the outlet 15 of the channel 14. The other bottom valve 11*c* may be positioned upstream along the channel 14 within the bottom hole assembly 8. The bottom valves 11*c*, 11*d* may be conventional drill string check valves as are used with single bore drill string components. Upper valves 11*a*, 11*b* may be positioned in the dual drill string 1. The upper valves 11*a*, 11*b*, may be specifically configured to connect within a nested dual drill string, for example, one shown in U.S. Pat. No. 3,208,539 issued to Henderson, and the valves 11*a*, 11*b* may be referred to hereinafter for convenience as dual drill string valves.

In the present example, the top drive 24 may include a shutoff valve B1 in the return fluid flow line B and a crossover valve A1 that selectively makes hydraulic connection between the supply fluid flow line A and the return fluid line B. The function of the foregoing valves B1, A1 will be further explained.

Figure 2A:
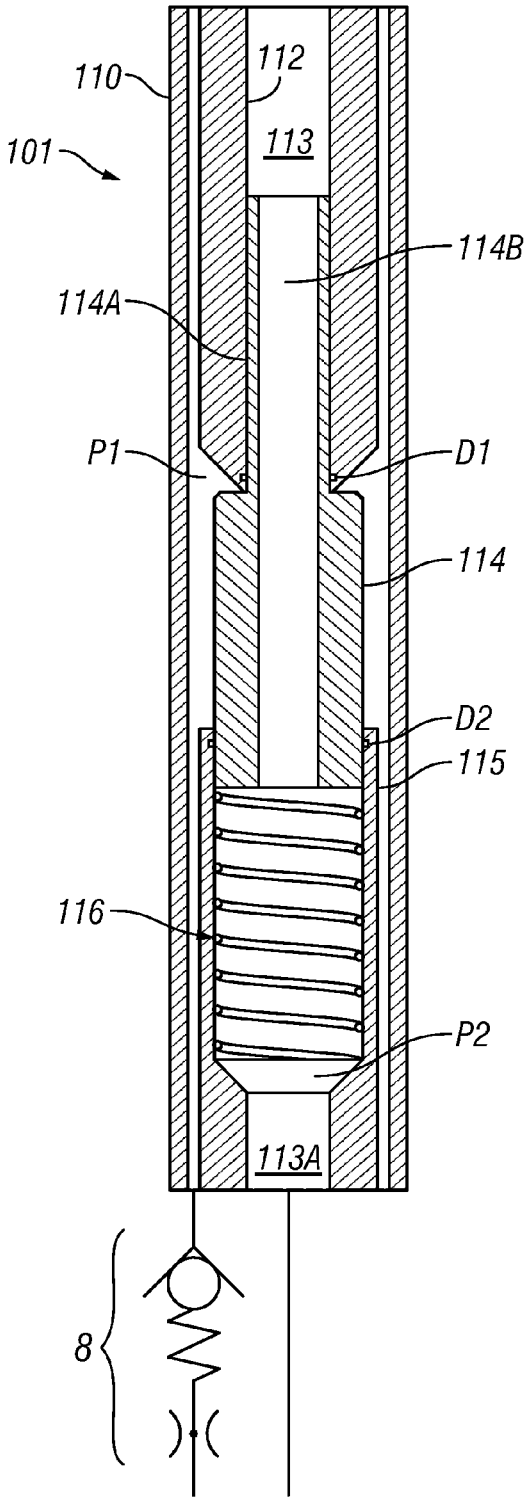
FIGS. 2A and 2B show cut away views of a dual drill string actuator, in the closed and open position, respectively
Figure 2B:
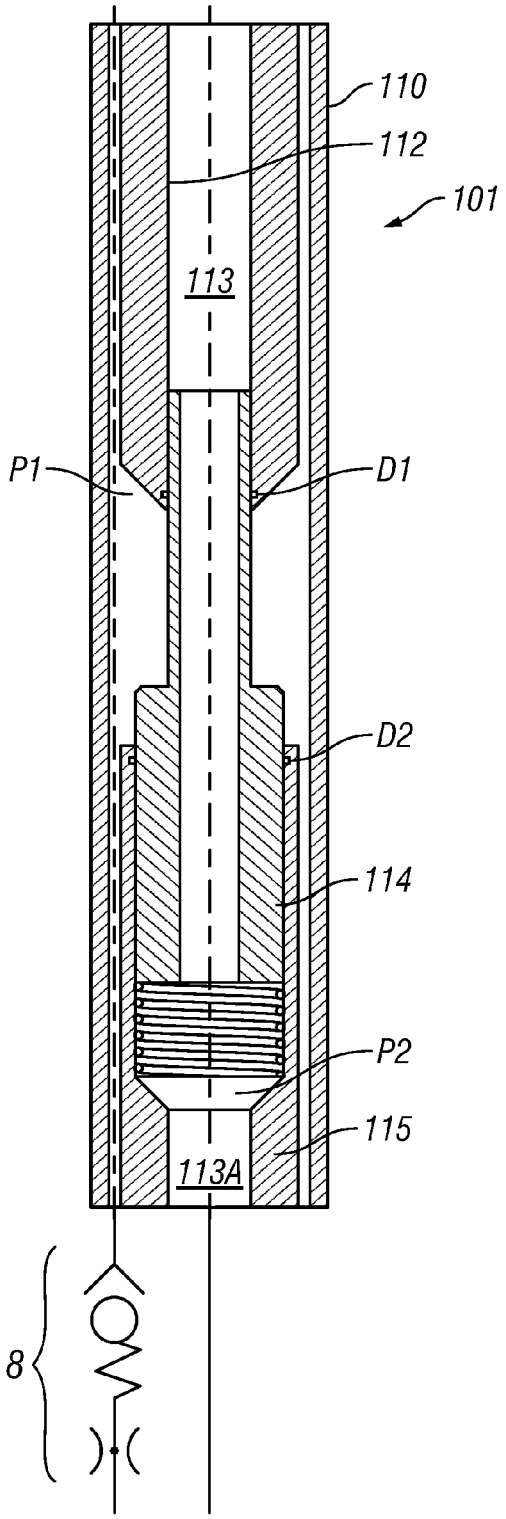

The dual drill string actuators and associated valves 11*a*, 11*b* may be better understood with reference to FIGS. 2A, 2B, 3A, 3B and 4A, 4B. An important component of a dual drill string valve according to the invention, and referring to FIGS. 2A and 2B, is a dual drill string compatible valve actuator 100. Referring to FIG. 2A, an example dual drill string actuator 100 may be enclosed in a housing 110 that may have connections (not shown separately) at each longitudinal end for engaging the housing 110 to a segment of the dual drill string, e.g., 1 in FIG. 1) on one or both longitudinal ends thereof "Engagement" may include metal to metal or other form of sealing between the housing 110 and each connected segment of the outer pipe, as explained with reference to FIG. 1. "Engagement" may further include having an upper internal conduit 112 mounted in fixed longitudinal position within the housing 110. Such mounting may include, without limitation, friction fit standoffs, welding, adhesive bonding, etc. The upper inner conduit 112 may be configured to sealingly engage the inner pipe (3 in FIG. 1) to enable completion of the fluid return flow passage (5 in FIG. 1) through the actuator 100. A fluid return flow passage formed by the components of the actuator 100 is shown generally at 113 and 113A. As will be further explained below, the actuator 100 also may provide a fluid flow passage between the interior of the housing 110 and the exterior of the upper internal conduit 112, lower internal conduit 115 and additional components explained below. Thus, the actuator 100 may be configured so that its behavior with respect to the dual drill string (1 in FIG. 1) is essentially "transparent", that is, the drilling rig operator or user may handle the actuator 100 in essentially the same manner as any other segment of the dual drill string (1 in FIG. 1).

In the present example, a piston 114 may be disposed inside the housing 110 and may include at one longitudinal end a tube 114A that may slidingly engage with an interior bore of the upper inner conduit 112. The tube 114A may be sealed to the upper inner conduit 112 using seals D1 of any type known in the art enabling longitudinal motion while maintaining a pressure tight seal, e.g., o-rings or the like. The lower inner conduit 115 may be mounted in the housing 110 at the opposite longitudinal end of the housing 110. The lower inner conduit 115 may be configured at its longitudinal end to sealingly engage another segment of dual drill string such as shown in FIG. 1. The lower inner conduit 115 may be mounted inside the housing 110 in any manner as explained with reference to the upper inner conduit 112. The piston 114 may also slidingly engage the lower inner conduit 115. Such sliding engagement may include pressure tight sealing, for example, by using o-rings or similar seals such as shown at D2. Thus, the piston 114 may move longitudinally with respect to the upper 112 and lower 115 inner conduits while maintaining a sealed inner fluid passage, shown by the combination of elements 113, 114B and 113A. In the example shown in FIGS. 2A and 2B, a spring or biasing device 116 may urge the piston 114 into its raised position (FIG. 2A) in the absence of any fluid flow through the actuator 100.

The mounting of both the upper inner conduit 112 and the lower inner conduit 115 within the housing 110 may be configured to enable fluid flow in a passage formed between the interior wall of the housing 110 and the exterior of the upper inner conduit 112, the piston 114 and the lower inner conduit 115. Thus, the actuator 100 may be substantially transparent with respect to the dual drill string as it concerns fluid flow therethrough; there is provided by the described structure both an inner flow passage and an outer flow passage corresponding to such passages in the dual drill string (1 in FIG. 1).

Figure 3A:
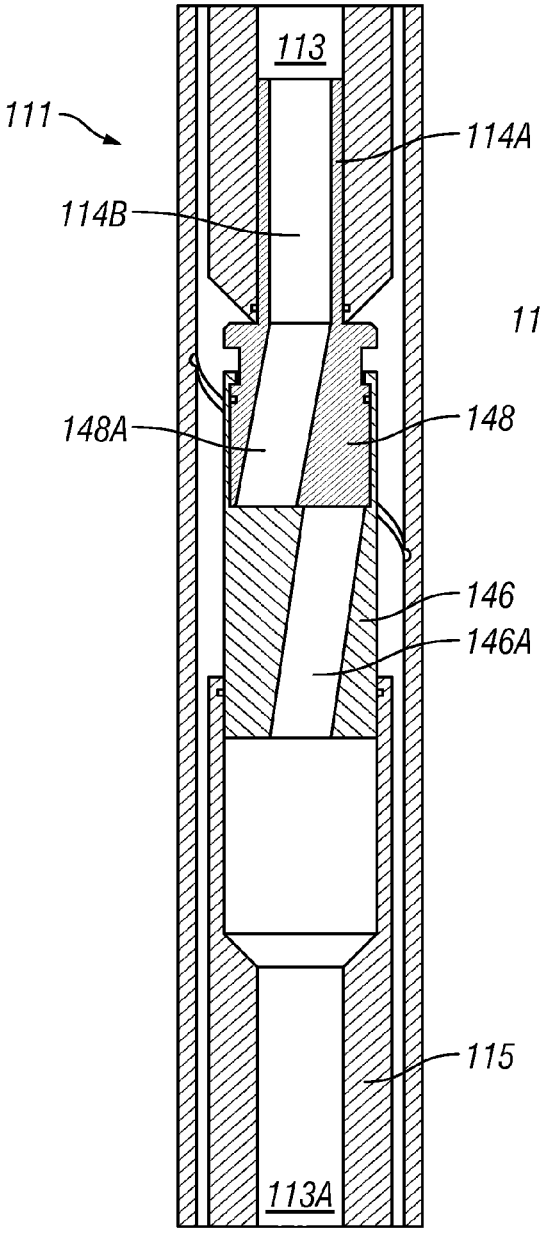
FIGS. 3A and 3B show an example dual drill string rotary valve in the open (activated) position and closed position, respectively.

Specifically referring to FIG. 2A, the actuator 100 is shown in its state that exists when the fluid supply flow (A in FIG. 1) is stopped. The BHA 8 is shown schematically at a position below the actuator 100. The BHA 8 may include a conventional float or check valve, shown at 8A, and the lower part of the BHA 8, which may include a "mud" drilling motor (not shown) and the drill bit (7 in FIG. 1) is shown schematically at 8B as a resistance to flow therethrough. In FIG. 2A, the piston 114 is in its uppermost position. Referring to FIG. 3A, when the fluid supply flow (A in FIG. 1) is turned on, pressure P1 will exist in the passage between the interior wall of the housing 110 and the exterior of the upper inner conduit 112, the piston 114 and the lower interior conduit 115. Because of the resistance to flow provided by the BHA 8, the pressure P1 will typically be greater than the pressure below the actuator 100, shown by P2. The pressure P1 acts on the piston 114 to move it downwardly, as shown in FIG. 2B. The float valve 8A is shown open in FIG. 2B, which results from flow leaving the actuator 100.

The actuator 100 shown in and explained with reference to FIGS. 2A and 2B may be used in conjunction with any other apparatus disposable in a drill string. For such use, it is only necessary to provide connection such that motion of the piston 114 causes operation of another device.

It will be appreciated that the flow diverter (6 in FIG. 1) and other detailed components of the BHA 8 have been omitted from FIGS. 2A and 2B for simplicity of the illustration. In actual drilling use, such components may be included in the dual drill string as required, for example, as shown in FIG. 1.

Figure 3B:
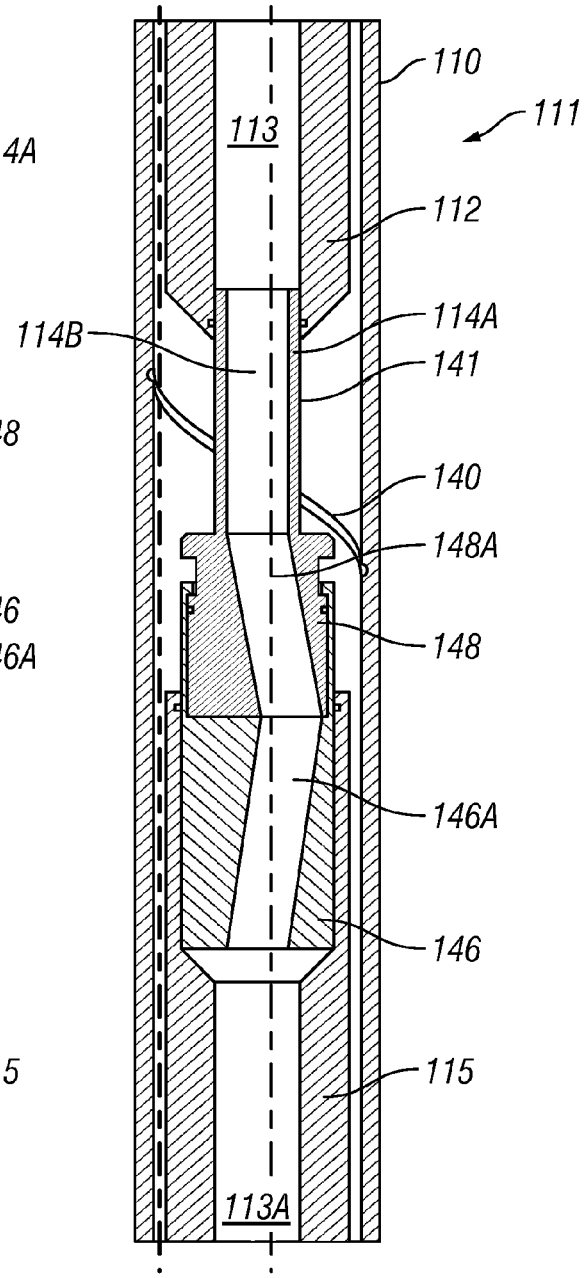

Referring to FIGS. 3A and 3B, one example of a drill string valve associated with the above described actuator will be explained. A drill string valve 111 using the actuator of FIGS. 2A and 2B may be formed by including within the piston structure (FIGS. 2A and 2B) a rotary valve. The rotary valve may be assembled from separate components, explained below, to form the piston (114 in FIGS. 2A and 2B), such that application of supply fluid flow (A in FIG. 1) will cause downward motion of the rotary valve, thereby causing it to open.

In the present example, the rotary valve may include a tube 114A that sealingly, slidably engages the upper inner conduit 112, as in the actuator shown in FIGS. 2A and 2B. The tube 114A may be sealed to the interior of the upper inner conduit using seals, D1 in FIG. 2B. The tube 114A may be affixed at its lower end to a rotatable valve disc 148. The rotatable valve disc 148 may include an internal passage 148A that is aligned with the passage 114B in the tube 114 where the tube 114 and rotatable valve disc 148 contact each other, and is laterally displaced at the lower end of the rotatable valve disc 148. The rotatable valve disc 148 may contact at its lower end a rotationally fixed valve plunger 146. The rotationally fixed valve plunger 146 may include a corresponding passage 146A (FIG. 3B) therein to provide fluid communication with passage 113A in the lower inner conduit 115. A helical guide 140 may be formed in the interior of the housing 110, for example, as a groove or as a ridge. A groove may provide easier assembly and disassembly of the valve 111, however this is not a limitation on the scope of the invention. A mating pin or groove, shown at 141, may be provided on the tube 114 or the rotatable valve disc 148.

When the fluid supply flow (A in FIG. 1) is turned on, and pressure P1 exists in the interior of the housing, but outside the tube 114, rotatable valve disc 148 and rotationally fixed valve plunger 146, the entire assembly of the foregoing components is urged downward by the differential pressure, essentially as explained with reference to the actuator described above. In the present example, however, engagement of the pin 141 with the groove 140 causes rotation of the rotatable valve disc 148. In the "closed" position shown in FIG. 3A, the passages 148A, 146A are misaligned, and the rotary valve is closed to flow. In FIG. 3B, when the foregoing assembly of components is moved downwardly by pressure P1, the rotatable valve disc 148 rotates so that the passages 148A, 146A are aligned to enable flow therethrough. Thus, the interior passage of the valve 111, consisting of upper inner conduit passage 113, tube passage 114B, valve disc/plunger passages 148A, 146A and lower inner conduit passage 113A form an open passage to fluid flow. In this way, when the fluid supply flow (A in FIG. 1) is stopped, the passage just described will close, thereby stopping flow from the well into the fluid return flow (B in FIG. 1) part of the dual drill string (e.g., 5 in FIG. 1). Fluid flow into the fluid supply flow part of the dual drill string (e.g., 4 in FIG. 1) may be stopped by the float valve (8A in FIG. 2A).

A spring, such as shown at 116 in FIGS. 2A and 2B may be used in cooperation with the rotationally fixed valve plunger 146 to assist in closing the valve, substantially as explained with reference to FIGS. 2A and 2B.

Figure 4A:
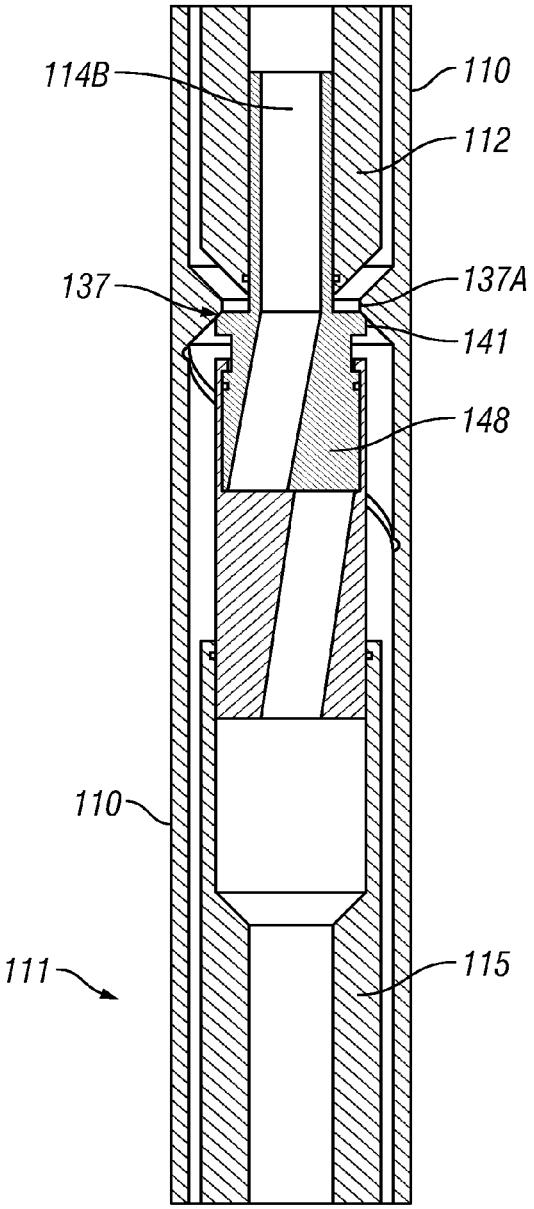
FIGS. 4A and 4B show an example dual drill string rotary valve in the open (activated) position and closed position, respectively.
Figure 4B:
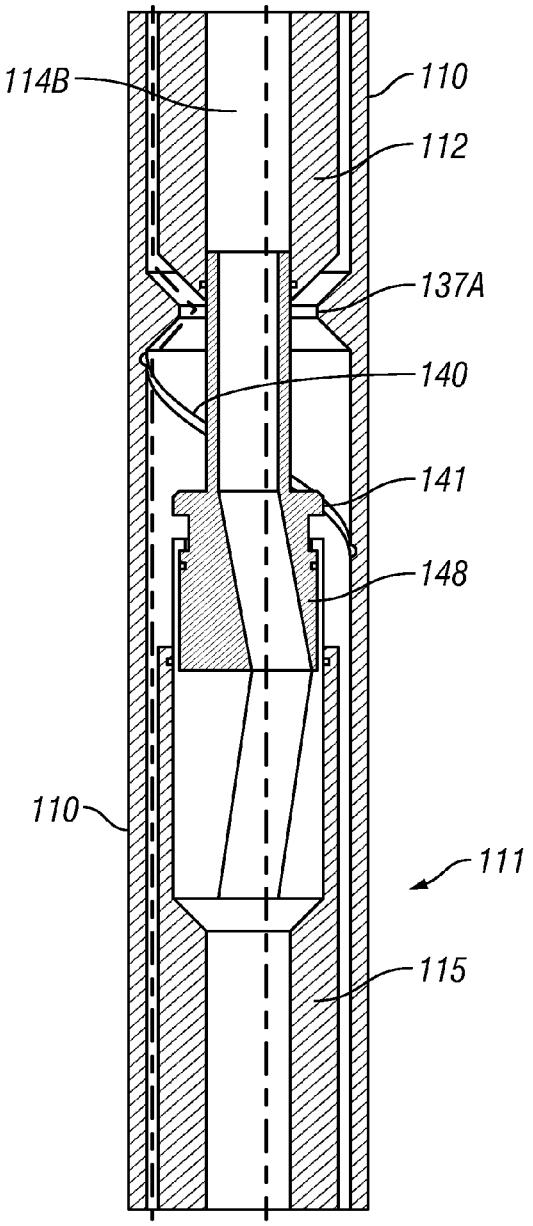

An alternative valve 111 may be better understood with reference to FIGS. 4A and 4B. The valve 11 shown in FIG. 4A (closed position) and FIG. 4B (open position) may include substantially all the components of the rotary valve shown in FIGS. 3A and 3B, with the addition of a valve seat 137 (FIG. 4A) that cooperatively engages a seal seat 137 (FIG. 4B) when the rotary valve components are in the position shown in FIG. 4A. Thus, a fluid flow passage formed inside the housing 110, but outside the upper inner conduit 112, tube 114, rotatable valve disc 148, rotationally fixed valve plunger 146 and lower inner conduit 115 will be closed to flow when the fluid supply flow (A in FIG. 1) is turned off.

Two or more of the valves shown in FIGS. 4A and 4B may be placed at selected longitudinal positions (e.g., as shown in FIG. 1) to provide additional wellbore pressure control.

The example actuators and valves shown in FIGS. 2A, 2B, 3A, 3B, 4A and 4B are not intended to limit the scope of the present invention. In addition, the example dual drill string shown in FIG. 1, wherein one pipe string is nested within another pipe string, is also not intended to limit the scope of the invention. For example, side by side dual drill strings are known in the art and may be equally used with the example method to be described below. See, for example, U.S. Pat. No. 3,955,622 issued to Jones.

Referring once again to FIG. 1, when the dual drill string 1 is run into the wellbore 17 to a selected depth, drilling may be resumed first by resuming circulation of the drilling fluid. It should be understood that running the dual drill string 1 into the wellbore 17 is not a prerequisite to performing the present example method. In other examples, the dual drill string 1 may already be at the selected depth, wherein circulation had been previously stopped for any other reason. In the present example, both the fluid supply flow passage (outer string flow path) 4 and return fluid passage (the inner string flow path) 5 may be initially dry because the shutoff valves 11*a*, 11*b*, 11*c*, 11*d* are closed, or the passages 4, 5 may be fluid filled and the shutoff valves 11*a*, 11*b*, 11*c*, 11*d* closed because fluid circulation had been previously stopped. Pumping of the supply fluid A may commence, and the crossover valve A1 in the top drive 24 or elsewhere may hydraulically connect the fluid supply flow passage 4 and fluid return flow passage 5 so that both are simultaneously filled with fluid, or if the passages 4, 5 are already fluid filled, may operate to pressurize the fluid passages 4, 5. In some examples, the return flow path B may include a shutoff valve B1 that may be closed during the filling and/or pressurization of the dual drill string 1 with fluid. The foregoing valves A1, B1 n the top drive 24 are only examples of devices to fill and/or pressurize both passages simultaneously. Other flow control devices may be used to equal effect. When the both the return fluid passage 5 and the supply fluid passage 4 of the dual drill string 1 are filled with fluid and/or are pressurized, the bypass valve A1 may be closed, and fluid pumping may continue through the supply fluid flow passage 4. As the fluid travels further, through the crossover 41 and out the drill bit 7, the fluid enters the wellbore 17 and travels to the crossover 41, where it is directed to the fluid return passage 5. In some examples, only the fluid return passage 5 may be pressurized before resuming fluid circulation. In other examples, both passages 4, 5 may be pressurized substantially contemporaneously before fluid circulation is resumed.

During drilling, when the drilling unit pumps are running, the return flow in the inner pipe will create a friction pressure loss. The total bottomhole pressure in the wellbore 17 will be the sum of the drilling fluid density multiplied by the vertical depth, plus the friction pressure loss in the return passage 5. When drilling is stopped and the pressure in the dual drill string is bled off, (both passages 4, 5), e.g., for making pipe connections or for any other reason, the foregoing total bottomhole pressure less the friction loss pressure will be the pressure locked in, in particular in the return passage 5, by the above described valves.

To start or restart the drilling and/or circulation process and open the described valves again it is important (as it is desirable to maintain constant wellborefluid pressure) to equalize the differential pressure over the bottom hole inner pipe shutoff valve prior to opening thereof. Therefore in the present example the inner pipe channel may be pressurized prior to opening the valve therefor. The pressure may be increased so that the pressure in the return path 5 substantially matches the wellbore fluid pressure.

As explained above with reference to FIGS. 2 through 4, the fluid flow through the supply flow passage will open the shutoff valves 11*a*, 11*b*, 11*c*, 11*d*, enabling fluid to travel from the wellbore 17 into the return fluid passage 5. Because the return fluid flow passage 5 has been or already is filled with fluid prior to opening the shutoff valves 11*a*, 11*b*, 11*c*, 11*d*, by pressurizing the fluid return passage 5 so that its pressure is substantially equal to the wellbore fluid pressure, when the shutoff valves are opened, the fluid flowing from the wellbore 17 into the return fluid flow passage 5 will not be exposed to lower pressure as would be the case if the return fluid flow passage 5 were gas or air filled or were fluid filled and not otherwise previously pressurized to compensate for the friction pressure loss locked in by the respective shut off valve after circulation is stopped. By opening return flow into the return passage 5 only after substantially equalizing its pressure to the wellbore fluid pressure, rapid wellbore pressure drops and accompanying drilling hazards may be avoided.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for operating a dual drill string disposed in a wellbore, the string having a shutoff valve for at least a fluid return drill string therein proximate a bottom end thereof, comprising:

pumping fluid into the fluid return string through a valve in fluid communication therewith at a surface end of the fluid return string such that a pressure in the fluid return string is substantially equal to a fluid pressure in the wellbore; and initiating circulation of fluid in the wellbore by pumping fluid into a fluid supply string in the dual drill string such that the shutoff valve on the fluid return string opens to enable the fluid leaving the wellbore to enter the fluid return string, the pumping fluid into the fluid return string performed either contemporaneously with or prior to the initiating circulation.

2. The method of claim 1 wherein the dual drill string is a nested dual string and the initiating circulation is established when fluid is pumped into the wellbore through an outer string of the nested dual string and a flow crossover, and wherein the shutoff valve comprises a biasing device arranged to urge the shutoff valve to close when fluid is not pumped into the outer string.

3. The method of claim 2 wherein the biasing device comprises a spring.

4. The method of claim 1 pumping fluid into both the fluid return string and the fluid supply string until both the fluid return string and the fluid supply string are substantially filled with fluid to the surface.

5. The method of claim 1 wherein substantially contemporaneous pumping comprises pressurizing a fluid supply string in the dual drill string substantially contemporaneously with the pumping fluid into the fluid return string.

6. The method of claim 1 wherein the pumping fluid into the fluid return string is performed prior to the initiating circulation.

7. the method of claim 1 wherein the valve comprises a crossover valve interconnecting a surface end of the fluid supply string and the surface end of the fluid return string when the crossover valve is opened.

* * * * *